US006557934B2

(12) United States Patent
Wiecek

(10) Patent No.: US 6,557,934 B2
(45) Date of Patent: May 6, 2003

(54) MOTORIZED RECLINING MECHANISM AND FURNITURE ITEM

(75) Inventor: Glenn N. Wiecek, Shelbyville, KY (US)

(73) Assignee: L&P Property Management Company, South Gate, CA (US)

( * ) Notice: Subject to any disclaimer, the term of this patent is extended or adjusted under 35 U.S.C. 154(b) by 39 days.

(21) Appl. No.: 09/850,463

(22) Filed: May 7, 2001

(65) Prior Publication Data

US 2001/0028183 A1 Oct. 11, 2001

Related U.S. Application Data

(63) Continuation-in-part of application No. 09/298,334, filed on Apr. 23, 1999, now Pat. No. 6,231,120.

(51) Int. Cl.[7] ..... A47C 1/02
(52) U.S. Cl. ..... 297/84
(58) Field of Search ..... 297/84, 85, 68, 297/83, 423.19, 423.2, 423.1

(56) References Cited

U.S. PATENT DOCUMENTS

| | | | | |
|---|---|---|---|---|
| 276,687 | A | | 5/1883 | Hartley |
| 649,383 | A | | 5/1900 | Wilcke |
| 2,169,550 | A | | 8/1939 | Arends |
| 2,879,833 | A | | 3/1959 | Fletcher |
| 3,012,816 | A | | 12/1961 | Lorenz et al. |
| 3,039,814 | A | | 6/1962 | Schliephacke |
| 3,794,381 | A | | 2/1974 | Caldemeyer |
| 3,869,169 | A | | 3/1975 | Johnson et al. |
| 4,226,468 | A | | 10/1980 | Johnson |
| 4,357,049 | A | | 11/1982 | Rogers, Jr. et al. |
| 4,386,803 | A | * | 6/1983 | Gilderbloom |
| 4,506,925 | A | | 3/1985 | Crum |
| 4,531,778 | A | | 7/1985 | Rogers, Jr. |
| 4,577,902 | A | | 3/1986 | Crum |
| 4,696,512 | A | * | 9/1987 | Burnett et al. |
| 4,715,654 | A | | 12/1987 | Laskowitz |
| 4,844,536 | A | | 7/1989 | Mizelle |
| 4,895,411 | A | | 1/1990 | Pine |
| 4,904,019 | A | | 2/1990 | May |
| 5,007,679 | A | | 4/1991 | Mizelle |
| 5,013,084 | A | | 5/1991 | May |
| 5,141,284 | A | | 8/1992 | LaPointe |
| 5,368,366 | A | | 11/1994 | Mizelle |
| 5,388,886 | A | | 2/1995 | LaPointe et al. |
| 5,480,209 | A | | 1/1996 | May |
| 5,582,457 | A | | 12/1996 | Komorowski et al. |
| 5,653,498 | A | | 8/1997 | Grandfield |

FOREIGN PATENT DOCUMENTS

| | | |
|---|---|---|
| DE | 29707730 U | 7/1997 |
| EP | 0680713 A | 11/1995 |

* cited by examiner

*Primary Examiner*—Milton Nelson, Jr.
(74) *Attorney, Agent, or Firm*—Wood, Herron & Evans, L.L.P.

(57) ABSTRACT

A reclining mechanism for a furniture item includes support structure adapted for attachment to the furniture item, a footrest support bar connected for longitudinal movement with respect to the support structure between extended and retracted positions and actuating structure connected with the footrest support bar. The footrest support bar includes an S-shaped section and is connected to a footrest member for supporting the legs of the seat occupant. The actuating structure moves the footrest support bar along the S-shaped section between the extended and retracted positions to closely approximate a conventional footrest portion of a reclining mechanism, while presenting a simplified construction.

24 Claims, 10 Drawing Sheets

MOTORIZED RECLINING MECHANISM AND FURNITURE ITEM

RELATIONSHIP TO OTHER APPLICATIONS

This patent application is a continuation-in-part application of U.S. patent application Ser. No. 09/298,334, filed Apr. 23, 1999, now U.S. Pat. No. 6,231,120, the disclosure of which is fully incorporated by reference herein.

FIELD OF THE INVENTION

This invention generally relates to reclining furniture and, more specifically, to a three-way reclining furniture item having a moveable seat, backrest and footrest.

BACKGROUND OF THE INVENTION

Conventional reclining furniture items, such as chairs, sofas and sectionals, generally have either two-way or three-way mechanisms for allowing the chair to be moved between upright and reclined positions. In a two-way mechanism, the seat is fixed to the backrest as a unitary structure so that the angle between the seat and backrest remains the same during reclining motion. If the piece of furniture has a three-way mechanism, the top of the backrest will angle downwardly and rearwardly relative to the seat as the furniture item moves from an intermediate reclined or so-called T.V. position to a fully reclined position. Likewise, the backrest will move or tilt back up as the furniture item moves from the fully reclined position to the T.V. position. Among the concerns with reclining mechanisms in general are complexity and cost issues. These mechanisms can comprise large numbers of linkages and pivots to give the desired movement to the furniture item. Understandably, the more linkages and pivot connections in a given reclining mechanism, the higher the cost of manufacture and assembly. It has also become conventional practice to design reclining mechanisms with "zero wall proximity" ability. This refers to the ability to place the item of furniture with the top of the backrest against or very close to a wall while still allowing movement of the furniture item into both intermediate and fully reclined positions without encountering interference from the wall. Generally, the addition of this feature to a mechanism has even further complicated the typical three-way reclining mechanism. Another problem associated with reclining mechanisms has been the noise that they produce in moving between the different chair positions. Again, this noise can be associated with the numerous moving linkages in the mechanisms.

There have been many attempts to incorporate rollers in reclining mechanisms in various ways to produce mechanisms allowing different movements. For example, see U.S. Pat. Nos. 3,874,724; 4,072,342; 4,364,603; 4,531,778; and 5,823,614. One area of improvement that would be desirable relates to the footrest linkage of the mechanism. Conventionally, a scissor linkage assembly has been incorporated to extend and retract the footrest. Consumers have become widely familiar and comfortable with the typical footrest movement between the retracted and extended positions. However, the linkage assemblies have high numbers of links and pivots and present exposed pinch points. Certain consumers may also find them unattractive when in the extended position.

Alternative designs have been proposed to simplify the typical footrest scissor linkage, however, none of these alternatives have been fully acceptable. For example, alternative footrest mechanism constructions are shown in U.S. Pat. Nos. 4,506,925 and 4,844,536. In general, the mechanisms shown in these patents substitute bars which carry a footrest between retracted and extended positions using linkages, rollers or both. One major drawback with previous proposals such as these is that the resulting movement of the footrest does not closely approximate the typical movement of a footrest as refined through years of reclining mechanism development. This is believed to be one reason that these alternative footrest constructions have not been accepted in the industry.

In view of various problems with reclining mechanisms, such as three-way reclining mechanisms, it would be desirable to simplify these mechanisms and make them more attractive by significantly reducing the number of linkages in the footrest support and actuation portion, while also reducing costs, noise and potential pinch points associated with the mechanisms. At the same time, it would advantageous to provide a mechanism which fully reclines in a smooth manner without significant effort by the seat occupant and without interfering with a closely adjacent wall located behind the backrest.

SUMMARY OF INVENTION

The present invention improves upon past reclining mechanisms by incorporating a simplified footrest support bar and actuating system that closely approximates the typical arc-shaped movement of an extending and retracting footrest mechanism. In the preferred embodiment, a reclining mechanism is provided for a furniture item to allow movement between upright and reclined positions. More specifically, this may include one upright position and two reclined positions, typically referred to as an intermediate reclined position or T.V. position and a fully reclined position. The reclining mechanism generally includes support structure adapted for attachment to the furniture item, and a footrest support bar connected for longitudinal movement with respect to the support structure between extended and retracted positions. In the preferred embodiment, the support structure includes a track and the footrest support bar is connected for movement along the track. At least one of the track and the footrest support bar includes an S-shaped section. A first end of the footrest support bar is adapted for connection to a footrest member for supporting the legs of a seat occupant. Actuating structure is provided and connected with the footrest support bar and operates to move the footrest support bar along the S-shaped section between the extended and retracted positions.

The actuating structure is operated by a drive mechanism located between the reclining mechanisms. The drive mechanism preferably includes a motor assembly operable to rotate a drive tube. The drive tube is operatively connected to the actuating structure. However, drive mechanisms other than a motor assembly are within the scope of the present invention.

In one advantageous and preferred configuration, the S-shaped section is on the footrest support bar. The S-shaped section of the footrest support bar functions to closely approximate the movement of a conventional footrest mechanism. Also, in furtherance of this advantage, the footrest support bar includes at least one roller attached for rotation thereto and the support structure further includes a track. The roller is mounted for movement along the track between the extended and retracted positions. In the preferred embodiment, the track includes at least one curved section between the first and second ends and, more preferably, the entire track curves upward and then downward from a rear portion to a front portion thereof.

While the support structure may take many forms, it preferably includes a seat supporting member mounted adjacent the footrest support bar in a manner allowing the actuating structure to travel along the track as the footrest support bar moves between the extended and retracted positions. The roller is attached proximate the second end of the footrest support bar and the track includes first and second stops, which may be the ends of the track, with the roller engaging the stops at the respective upright and reclined positions. In a three-way mechanism, the rollers will preferably engage the stops at the upright and intermediate reclined positions. The roller is connected for movement with the actuating structure along the track. At least one additional roller is connected to a front portion of the support structure adjacent the footrest support bar and engages the footrest support bar during movement between the extended and retracted positions. In the preferred embodiment, upper and lower rollers are connected to the front portion of the support structure. These upper and lower rollers will support and guide the footrest support bar during movement between the extended and retracted positions. Many other options, such as a zero wall proximity option, gliding option, swivel option, etc., may also be incorporated into a mechanism of the present invention.

The invention also generally contemplates a method of operating a footrest mechanism in a reclining furniture item as generally described above. The method involves maintaining the footrest in a generally vertical orientation, moving the footrest support bar simultaneously downward and outward, reorienting the footrest into an angled orientation, extending the footrest support bar through an upwardly and outward arc while the footrest moves through the angled orientation, and stopping the footrest support bar with the footrest in the generally horizontal orientation at an upper end of the arc and the footrest support bar extending between the seat and the footrest. The method further involves retracting the footrest support bar through an opposite downward and inward arc while the footrest moves through the angled orientation and moving the footrest support bar upward and inward toward the seat as the footrest approaches the seat. The footrest stops in the generally vertical orientation in a typical position tucked beneath the seat.

The invention further contemplates a reclining mechanism similar to the above-described mechanism but either alternatively or additionally including a footrest member that is connected for biased, pivotal motion with respect to the footrest actuating structure, such as the S-shaped footrest support bar. In one aspect, the footrest member is connected by at least one spring to the footrest actuating structure and the spring is mounted for movement into an over-center position for pivoting the footrest member into a leg supporting position upon extension thereof. In another aspect, the footrest member is pivotally connected to the footrest actuating structure in a pivoting fashion allowing pivoting motion in two directions whereby the front edge of the footrest member is pivotal downward in the leg supporting position and the rear edge of the footrest member is pivotal outward in the retracted position. This allows the footrest to float in a spring-biased fashion in concert with movement of the seat occupant's legs in the extended position. Also, as the footrest member is retracted against the furniture item, the rear edge of the footrest member, which becomes the upper edge in the retracted position, can pivot away from the furniture item in case of object, such as a person's body part, is caught between the footrest member and the remaining portions of the furniture item.

Additional features, objectives and advantages of the invention will be more readily appreciated from the description to follow, taken in conjunction with the accompanying drawings and the various configurations of the invention set forth in the appended claims.

DETAILED DESCRIPTION OF PREFERRED EMBODIMENTS

Figure 1:
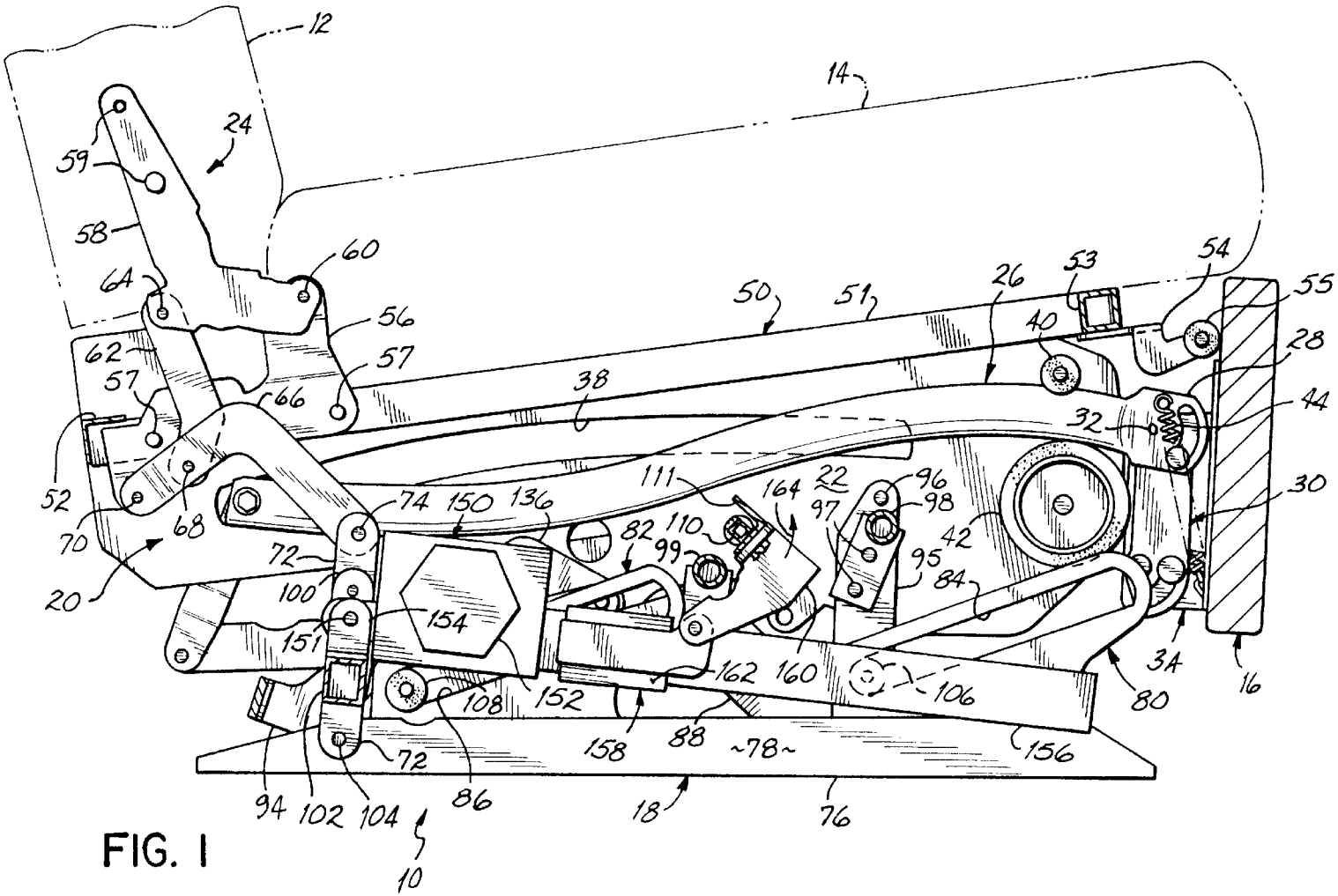
FIG. 1 is a longitudinal cross sectional view of a schematically illustrated furniture item depicting a reclining mechanism constructed in accordance with the invention and shown from an inside perspective.
Figure 2:
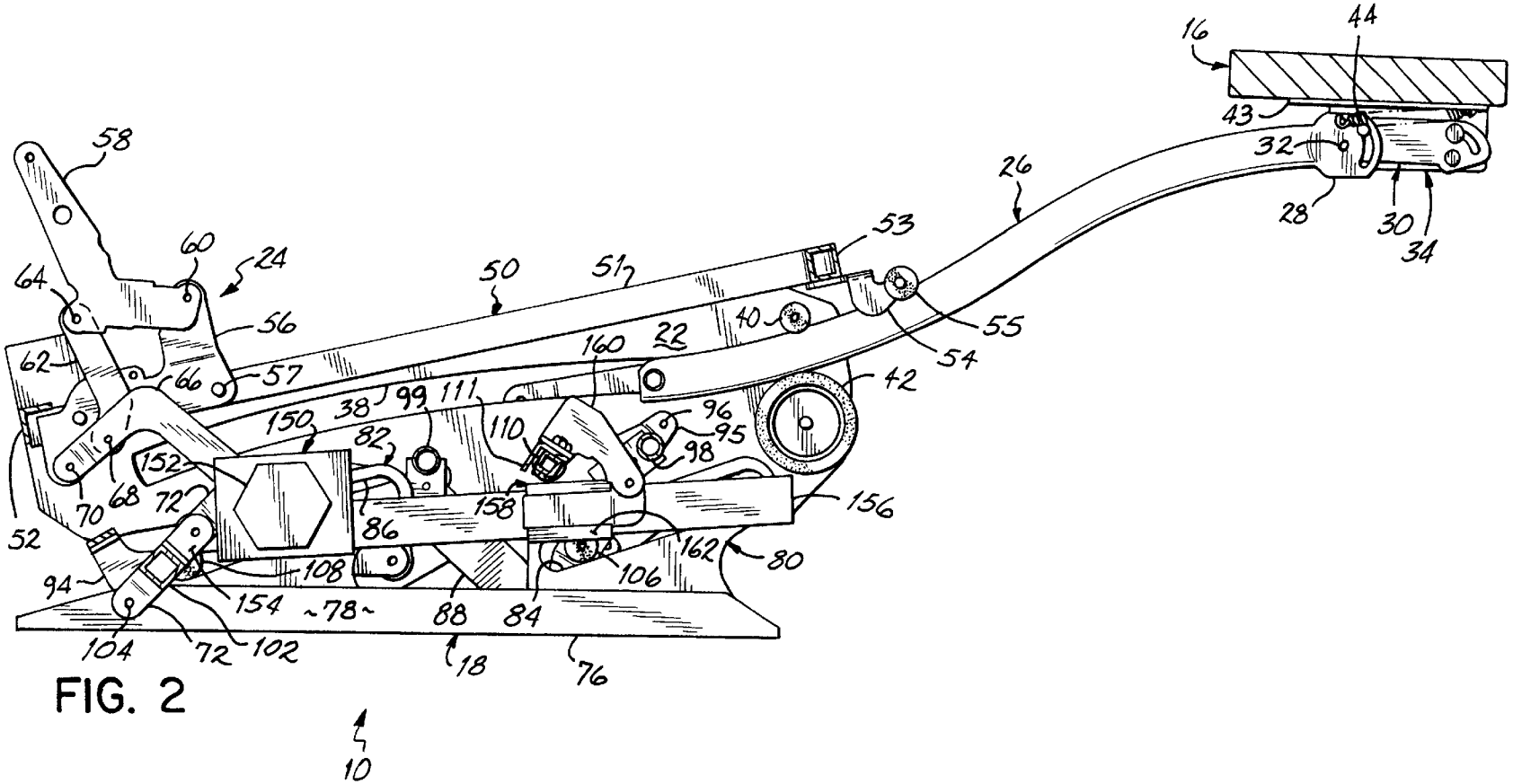
FIG. 2 is another longitudinal cross sectional view of the reclining mechanism shown in FIG. 1, but illustrated in the intermediate reclined or T.V. position.
Figure 3:
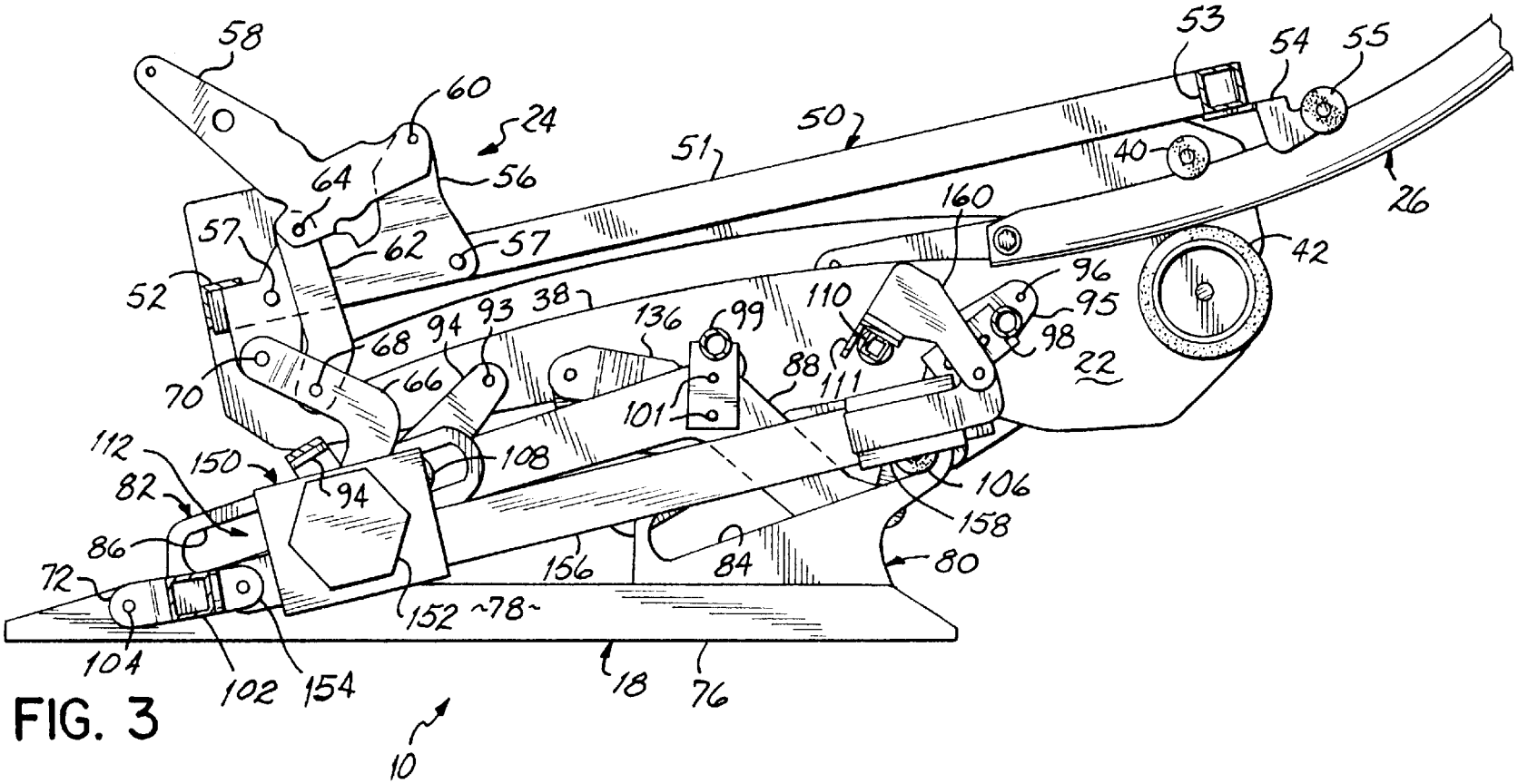
FIG. 3 is a partial cross sectional view similar to FIG. 2, but showing the mechanism in a fully reclined position.

Referring to FIGS. 1–3, a reclining furniture item 10 constructed in accordance with the preferred embodiment includes a schematically illustrated backrest 12 and seat 14. A footrest 16 is connected for extension and retraction in a manner to be described below. In this preferred embodiment, furniture item 10 is configured such that the backrest 12, seat 14 and footrest 16 move with respect to a base member 18 and by way of a reclining mechanism 20 between the fully upright position shown in FIG. 1 and respective intermediate reclined and fully reclined positions shown in FIGS. 2 and 3. It will be appreciated that many other mechanism configurations, including two-way and three-way mechanisms, may incorporate one or more features of this invention. It will also be understood that, as in the typical case, two reclining mechanisms will be used in a given item of furniture. These mechanisms will be mounted on opposite sides of seat 12 and will be mirror images of one another. Only a description of one mechanism 20 will be detailed herein with the understanding that another mirror image mechanism is connected on the opposite side of furniture item 10.

Reclining mechanism 20 includes a seat link or plate 22 connected for movement with seat 14 and backrest linkage 24 connected for movement with backrest 12. An S-shaped footrest support bar 26 has a front end portion 28. An extension 30 is pivotally secured at 32 to the front end portion 28 of the footrest support bar 26. The extension 30 is pivotally secured to a support bracket 34 affixed to footrest 16. A second, opposite end of the S-shaped footrest support bar 26 includes a roller 36 connected for rotation therewith. See FIGS. 4–6. Roller 36 is contained on a track which is preferably configured as a slot 38 contained within seat link 22. S-shaped footrest support bar 26 is further supported and guided at a front end of seat link 22 by upper and lower rollers 40, 42. These rollers engage footrest support bar 26 as it moves between retracted and extended positions as explained further below. The diameter of the lower roller 42 is larger than the diameter of the upper roller 40 to reduce the number of revolutions of the lower roller 42 and hence reduce the noise created thereby. In one preferred embodiment, the diameter of the lower roller 42 is three inches; however it may be any diameter.

Figure 7:
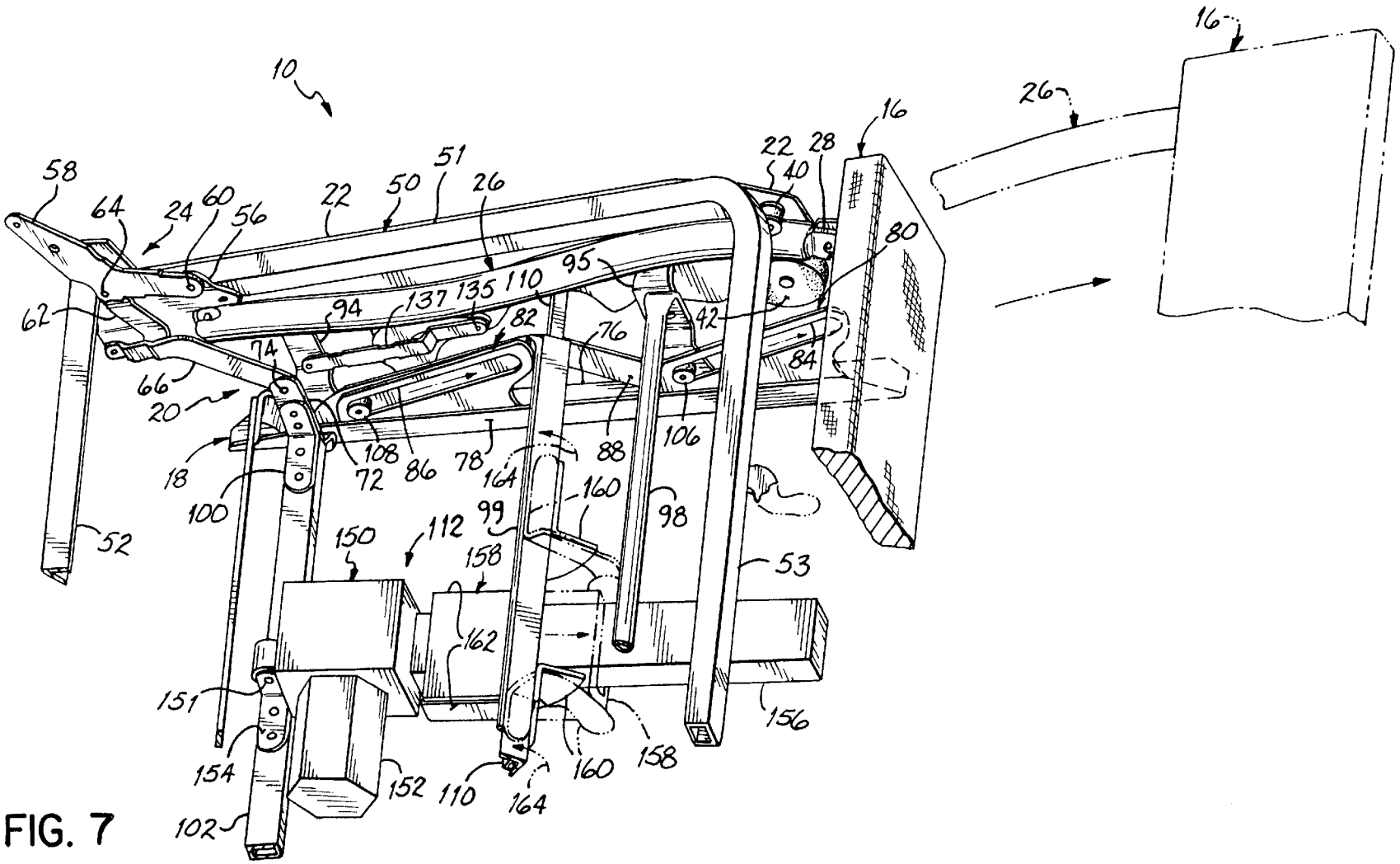
FIG. 7 is a fragmented top perspective view showing the drive mechanism of the present invention.
Figure 8:
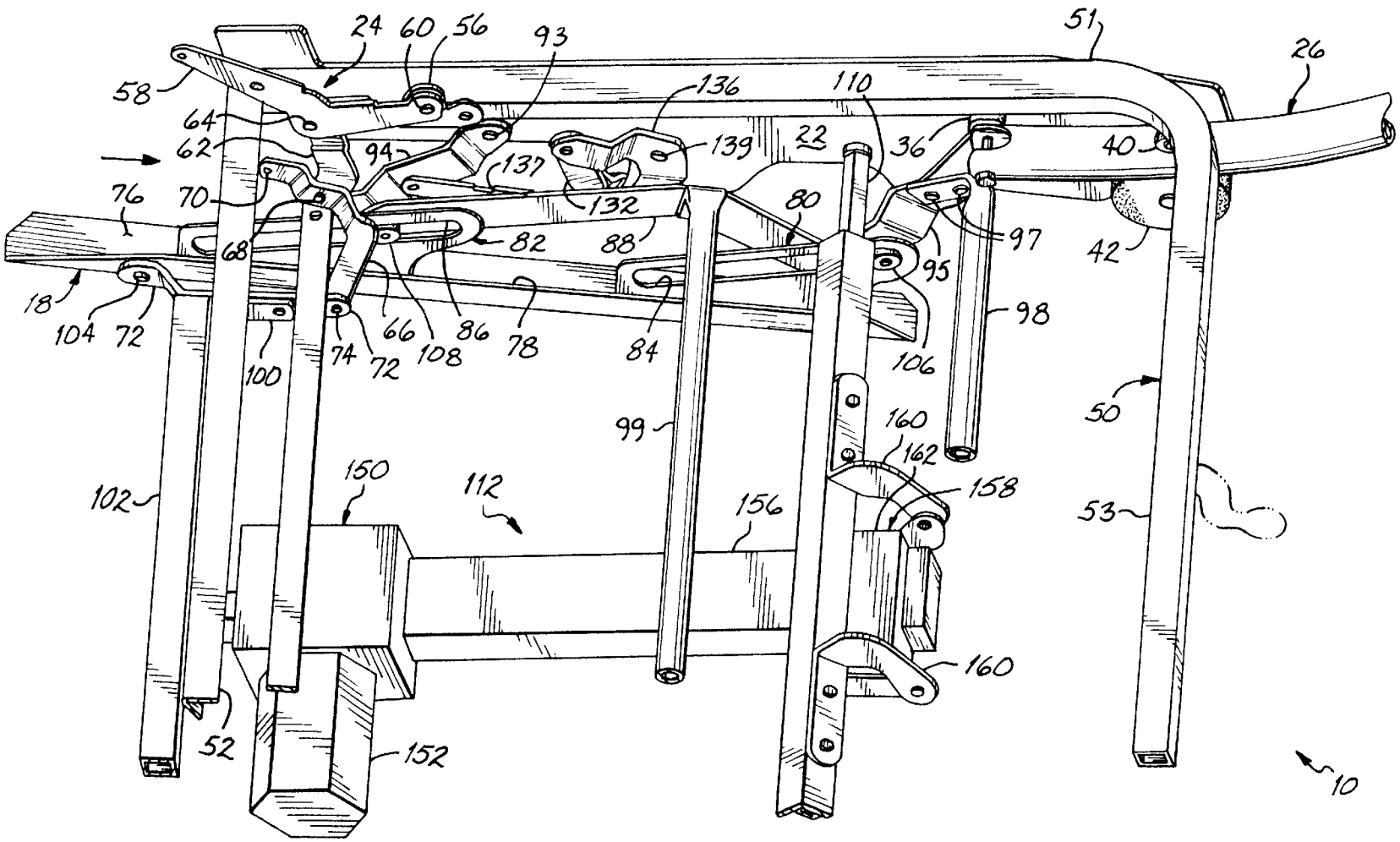
FIG. 8 is a fragmented top perspective view similar to FIG. 7, but showing the drive mechanism in a fully extended position.

As best illustrated in FIGS. 7 and 8, a generally rectangular seat supporting structure 50 comprises a pair of side portions 51, a rear portion 52 and a front portion 53. A bracket 54 supporting a roller 55 is secured to the front portion 53 of the seat supporting tube structure 50.

Referring to FIG. 1, backrest linkage 24 includes a link 56 rigidly secured by fasteners 57 to the side portion 51 of the seat supporting structure 50. A pivoting backrest link 58 is rigidly affixed to backrest 12 by fasteners 59 and includes a pivot 60 at one end secured to link 56. Another link 62 has one end pivotally secured to backrest link 56 at a pivot connection 64 and has an opposite, lower end connected with a link 66 at a pivot connection 68. Link 66 is generally L-shaped and includes a pivot connection 70 with link 56. A lower end of link 66 is connected with a further link 72 at a pivot connection 74. Link 72 is pivotally secured at 104 to the base member 18.

Figure 4:
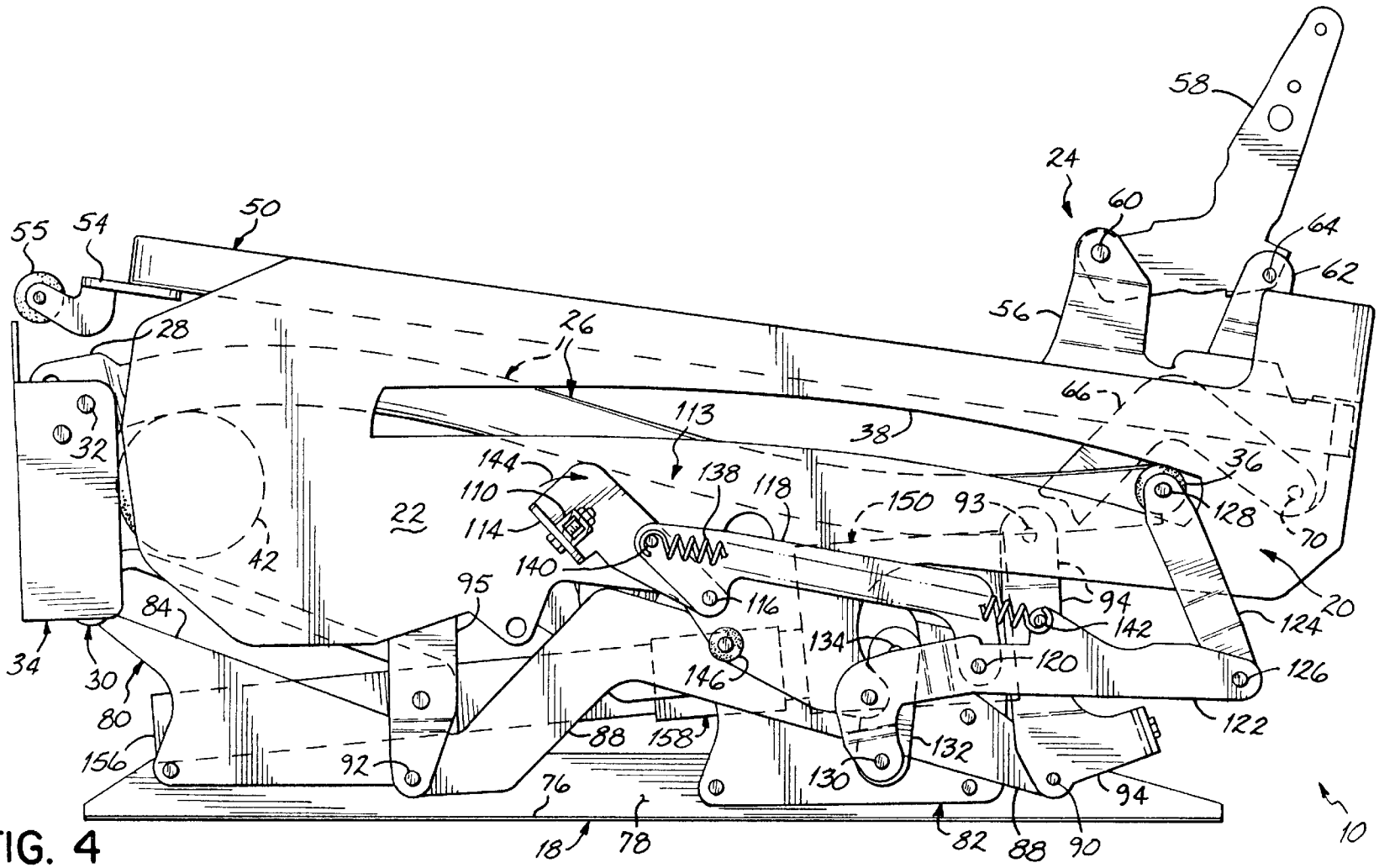
FIG. 4 is an elevational view of the reclining mechanism taken from an outside perspective.

As best illustrated in FIG. 4, base member 18 comprises a horizontally oriented first portion 76 adapted to engage the floor or supporting surface and a vertically oriented second portion 78 extending upwardly from the first portion 76 of the base member 18. Thus, the base member 18 has a generally L-shaped cross sectional configuration. Although one configuration of base member 18 is illustrated and described, other configurations may be utilized in accordance with the present invention.

Spaced front and rear slotted brackets 80, 82, respectively, are secured to the vertically oriented second portion 78 of the base member 18. The front bracket 80 has a front track or slot 84 and the rear bracket 82 has a rear track or slot 86 contained therein.

Also illustrated in FIG. 4, another link 94 is connected at its upper end at pivot connection 93 to an inside surface of seat plate 22. The lower end of link 94 is pivotally secured to a base plate or link 88 at a pivot connection 90. At its forward end, base plate or link 88 is pivotally secured at 92 to another link 95. Link 95 is pivotally secured at pivot connection 96 to an inside surface of seat plate 22. As best illustrated in FIGS. 1 and 7, a first cross bar 98 is secured to link 95 with fasteners 97. The cross bar 98 extends transversely from one reclining mechanism 20 to the other reclining mechanism. A second cross bar 99 likewise extends transversely from one reclining mechanism 20 to the other. The second cross bar 99 is secured to base plate 88 with fasteners 101. See FIG. 3.

As best illustrated in FIG. 7, an L-shaped bracket 100 is secured to the link 72 on the inside thereof and to a rotatable cross tube 102. The cross tube 102 extends between the links 72 of the reclining mechanisms 20.

Forward and rearward movement of seat 14 with respect to base member 18 is provided by front and rear rollers 106, 108 riding in respective front and rear tracks or slots 84, 86 contained in front and rear brackets 80, 82 respectively. As will be discussed below, this movement takes place between the T.V. or intermediate reclined position and the fully reclined position. It will be appreciated that rear roller 108 also moves independently of front roller 106 when the reclining mechanism 20 goes from the fully upright or closed position (FIG. 1) to the T.V. or intermediate reclined position (FIG. 2). As best illustrated in FIG. 7, rear roller 108 is connected to base link 88, while front roller 106 is connected to link 95.

Figure 1A:
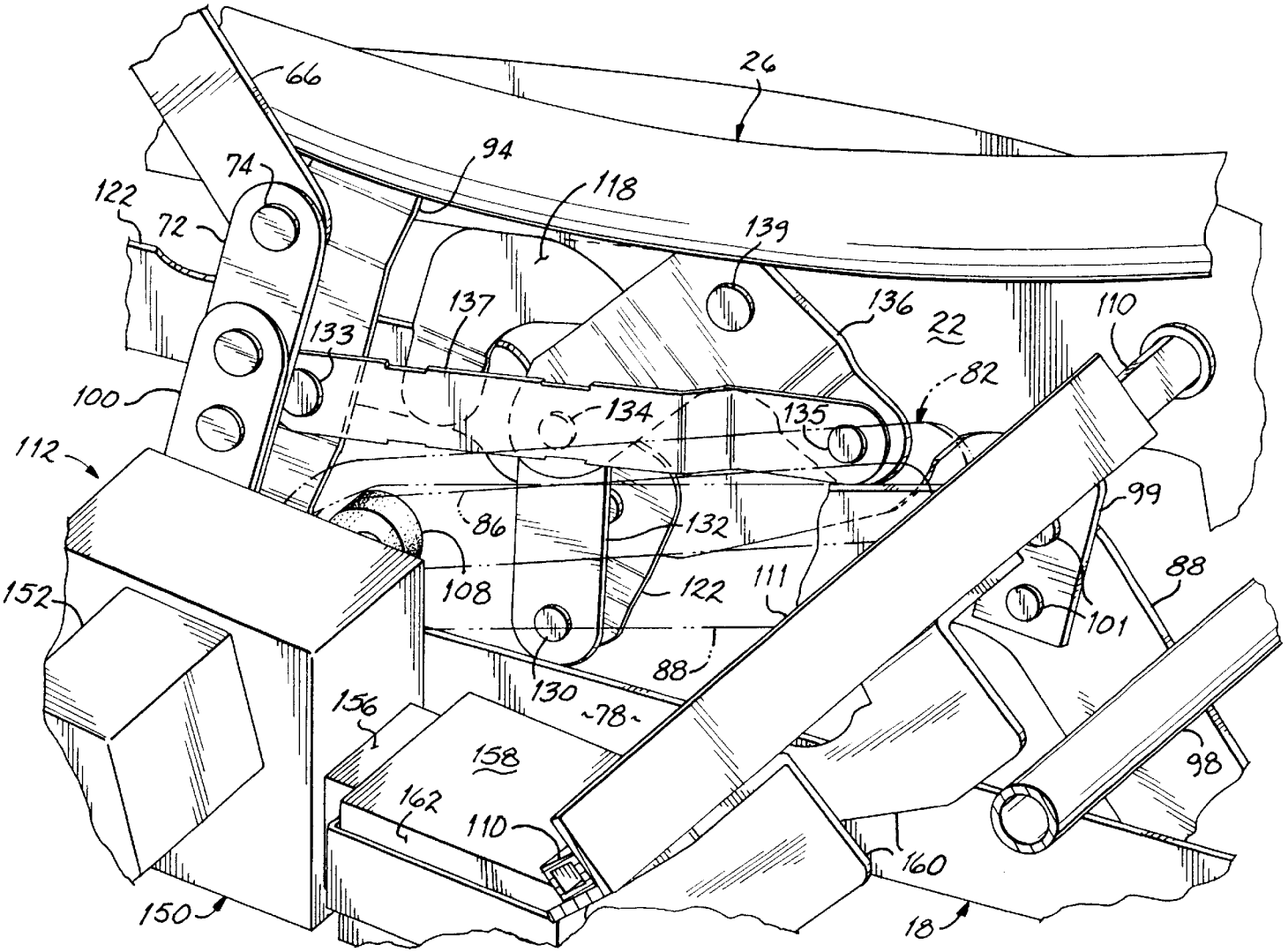
FIG. 1A is a perspective view of a portion of the reclining mechanism shown from an inside perspective with the drive assembly omitted for clarity.

As illustrated in FIGS. 7 and 8, a drive tube or torque tube 110 extending between the reclining mechanisms 20 is connected to a drive assembly 112 located therebetween. As best illustrated in FIG. 1A, a piece of angle iron 111 is secured to the drive tube 110. The drive assembly 112 is operated by a seat occupant and will be described in more detail below. It will be appreciated that actuation members or assemblies other than the drive assembly 112 illustrated and described may be utilized to rotate the drive tube 110. In addition, it will be appreciated that the drive assembly 112 may be located at other locations other than between the reclining mechanisms 20.

Figure 5:
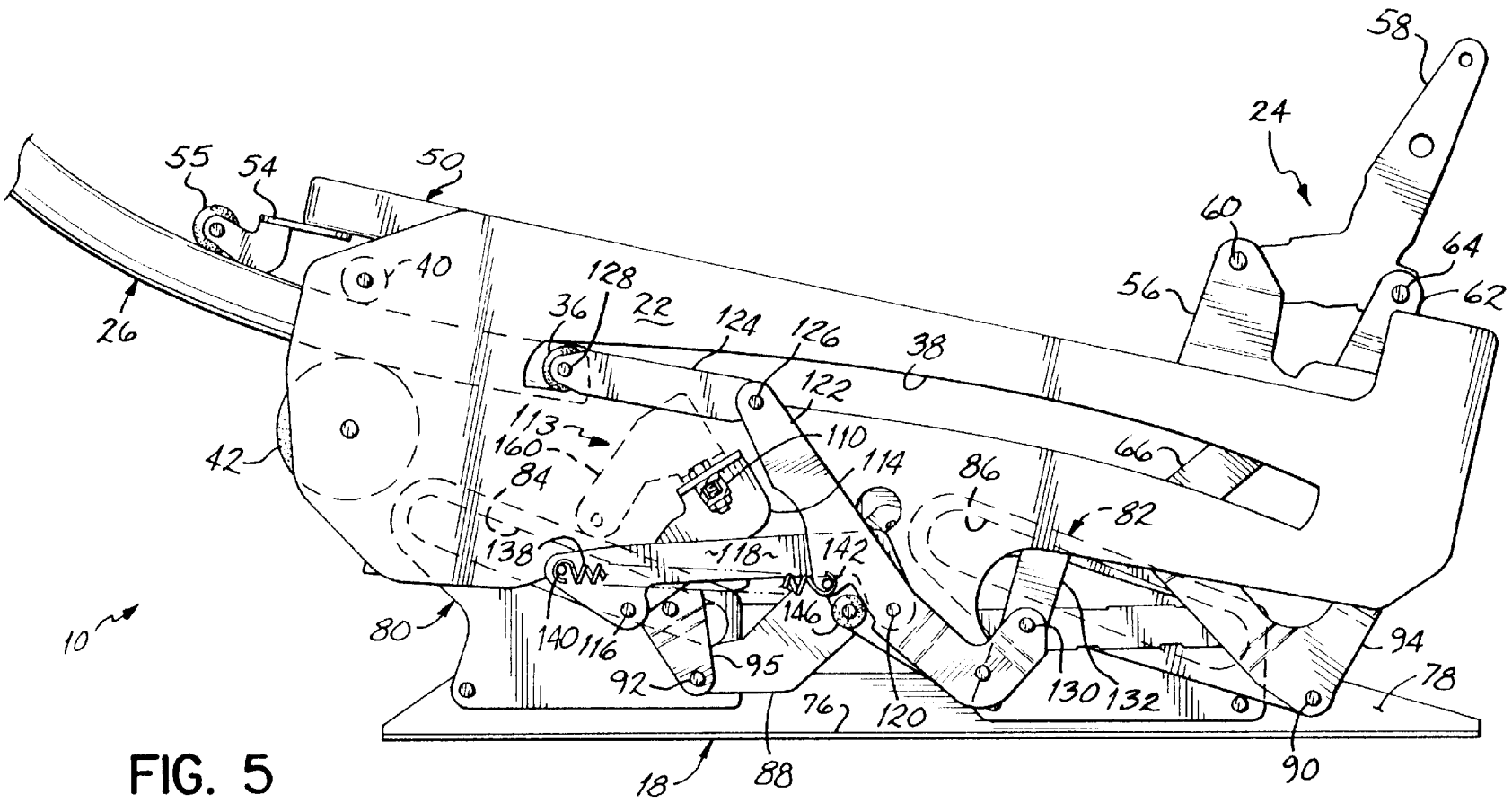
FIG. 5 is a partial elevational view similar to FIG. 4, but showing the mechanism in the intermediate reclined or T.V. position.
Figure 6:
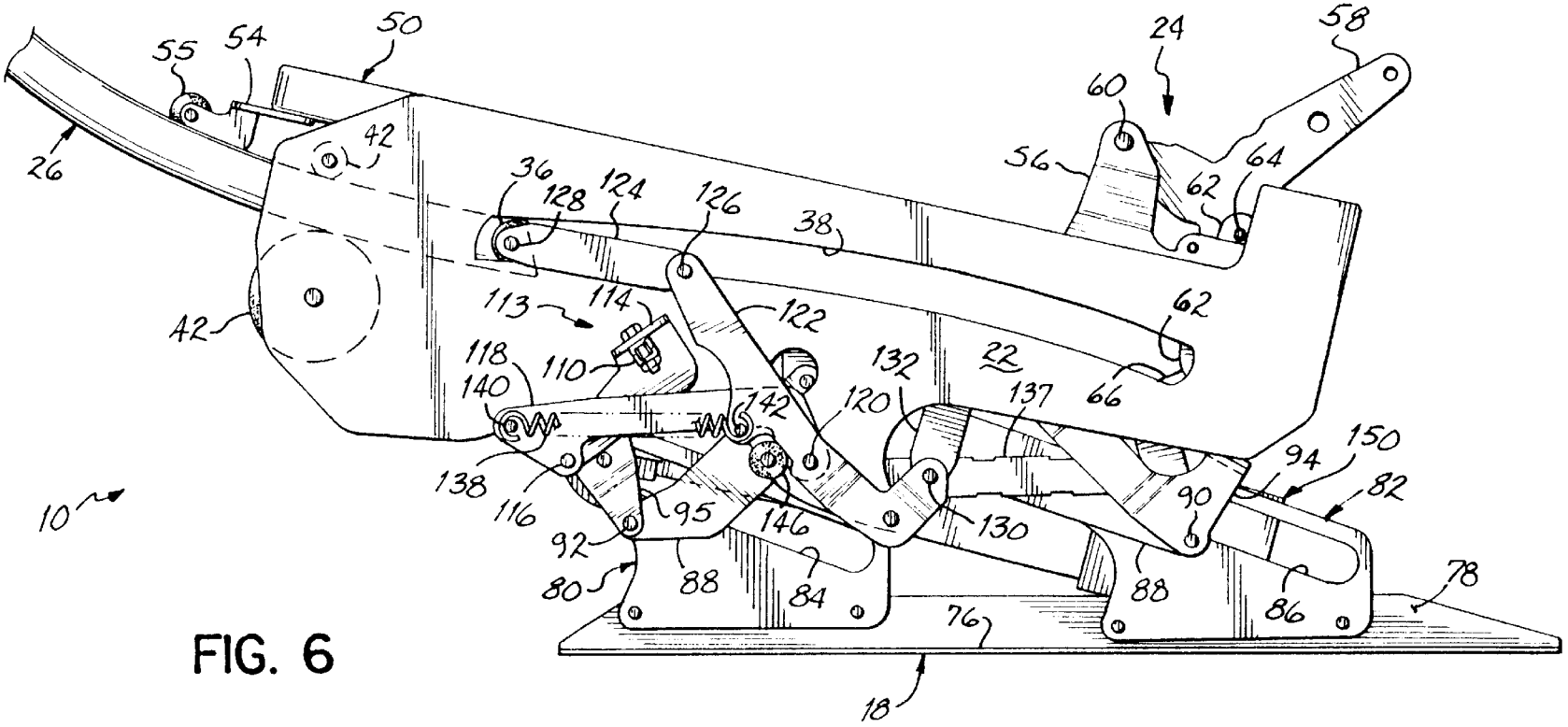
FIG. 6 is a partial elevational view similar to FIG. 5, but showing the reclining mechanism in a fully reclined position.

FIGS. 4–6 respectively illustrate the fully upright, intermediate reclined or T.V. and fully reclined positions of mechanism 20 from an outside or elevational view. This better illustrates the actuating structure 113 for extending the footrest 16. Actuating structure 140 preferably comprises links 114, 118, 122 and 124 connected for movement upon rotation of drive tube 110. Bell crank link 114 is affixed for rotation with drive tube 110 and drive tube 110 is connected with drive assembly 112, as described below, which is activated by a seat occupant. Bell crank link 114 is connected by a pivot connection 116 to a connecting link 118. Another pivot connection 120 joins connecting link 118 to a drive link 122. Drive link 122 is secured to secondary drive link 124 at pivot connection 126. Secondary drive link 124 is secured at its opposite end to S-shaped footrest support bar 26 through roller 36 at pivot connection 128.

The other end of drive link 122 rotates about a pivot connection 130 to another link 132. As illustrated in FIG. 1A, an upper end of link 132 is secured to one end of V-shaped link 136 at 134. The other end of the V-shaped link 136 is secured to link 137 at pivot connection 135. The apex of V-shaped link 136 is secured at 139 to the seat plate/link 22. The opposite end of link 137 is secured at pivot connection 133 to the inside surface of link 94.

Referring back to FIGS. 4–6, an extension spring 138 is connected between a stud 140 extending outwardly from connecting link 118 and another stud 142 extending outwardly from drive link 122.

During movement from the fully upright position shown in FIG. 1 to the T.V. position shown in FIG. 2, rotation of the drive tube 110 causes rotation of the bell crank link 114 located outside of the seat link/plate 22 in the direction of arrow 144 (see FIG. 4). Rotation of the bell crank link 114 causes the connecting link 118 to pull forwardly. The forward motion of the connecting link 118 causes the drive link 122 to rotate about a horizontal axis at pivot connection 130. Spring 138 helps pull the drive link 122 forwardly. As the drive link 122 moves forwardly, the secondary drive link 124 pulls forwardly as well, causing the S-shaped footrest support bar 26 to move forwardly.

During movement from the fully upright position shown in FIG. 1 to the T.V. position shown in FIG. 2, the drive link 122 rotates until it abuts a stop 146 which extends outwardly from the seat link or plate 22. As shown in FIG. 5, the stop 146 stops the rotation of the drive link 122.

FIGS. 7 and 8 illustrate the drive assembly 112 referred to above. The drive assembly 112 is located between the two opposed reclining mechanisms 20. The preferred embodiment of drive assembly 112 is a motor assembly 150. While many different motor assemblies may be used, one which has proven satisfactory is model 9.25.000.080.30 manufactured by OKIN, Antriebstechnik GmbH & Co. in Gummersbach, Germany.

The motor assembly 150 is pivotally secured at 152 to cross tube 102 by brackets 154. The motor assembly 150 comprises a motor 152, a drive housing 156 extending forwardly from the motor 152 and a movable housing 158 which travels the length of the drive housing 156. A pair of spaced L-shaped brackets 160 are secured to the sides 162 of the housing 158 and to the drive tube 110.

Upon activation of the motor 152, a threaded drive shaft inside drive housing 156 rotates, causing the housing 158 which has a threaded nut or block (not shown) therein to travel forwardly along the drive housing 156. The forward motion of the housing 158 causes the L-shaped brackets to rotate the drive tube 110 in the direction of arrow 164 (see FIG. 7). FIG. 7 illustrates the drive assembly 112 when the reclining mechanisms 20 are in the closed and tv positions, the tv position being illustrated in phantom. FIG. 8 illustrates the drive assembly 112 when the reclining mechanisms 20 are in the fully reclined position.

Figure 9A:
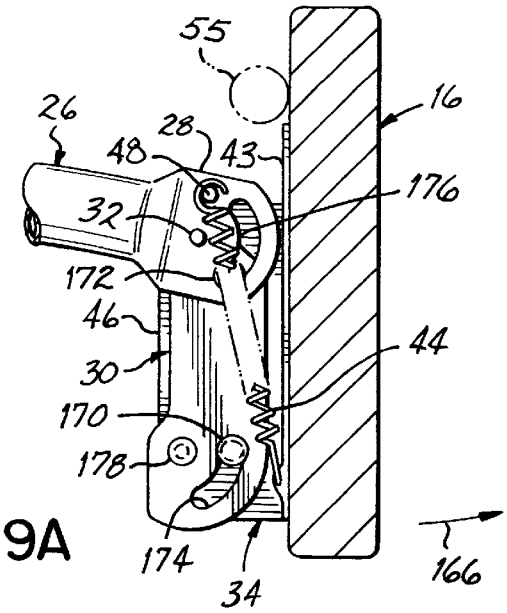
FIGS. 9A–9C are enlarged views of the footrest member showing the various positions and pivotal motions thereof.
Figure 9B:
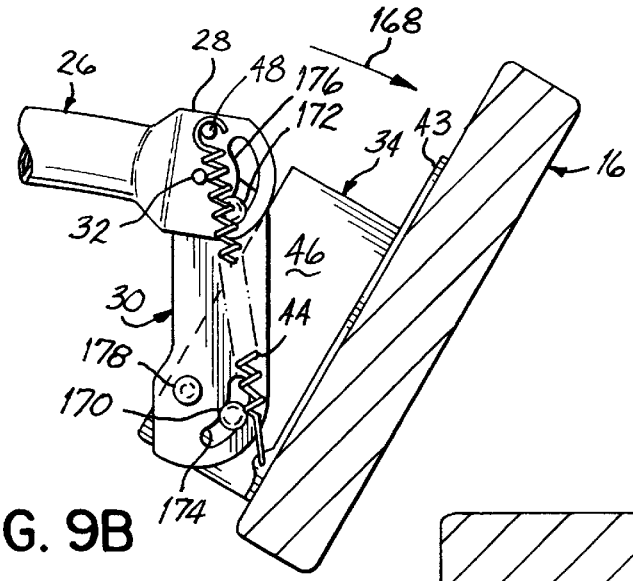
Figure 9C:
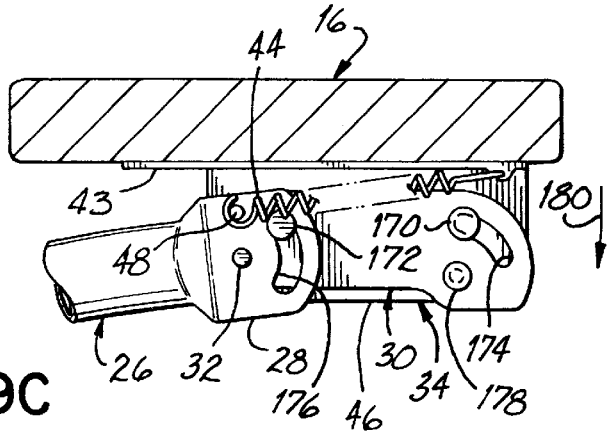

FIGS. 9A–9C illustrate the mounting and various possible movements of footrest 16 at the end of footrest support bar 26. Bracket 34 has a generally planar first portion 43 secured to the underside of footrest 16 and a generally planar second portion 46 extending downwardly therefrom. A spring 44 is connected to the first portion 43 of bracket 34 and further connected to a stud 48 extending from the end portion 28 of footrest support bar 26. Spring 44 is disposed above pivot 32 between bracket 34 and support bar 26 in essentially an on-center position when footrest 16 is in a retracted position. Spring 44 moves to an over-center position under the weight of a seat occupant's legs as footrest 16 moves to the extended position as shown in FIGS. 2 and 9C. Once in this position, footrest 16 can float in accordance with leg movement of the seat occupant in a manner described below.

Footrest 16 is mounted on a support bracket 34 connected for pivotal movement on the end of support bar 26 by way of pivot 32. As shown in FIG. 9A, with footrest 16 in the retracted position, spring 44 is essentially on-center with pivot 32. As footrest 16 is extended in the direction of arrow 166, spring 44 moves to an over-center position as shown in FIG. 9C thereby automatically flipping footrest 16 into a horizontal leg supporting position.

As further shown in FIGS. 9A–9C, a pair of studs 170, 172 extend outwardly of the second portion 46 of bracket 34. One of the studs 170 engages a groove 174 formed in the extension 30. The other stud 172 engages a groove 176 formed in the end portion 28 of the footrest support bar 26. The engagement of the stud 170 and the groove 174 allows a top edge 16*a* of footrest 16 to rotate outward about pivot 178 in the direction of arrow 168 from the furniture item when footrest 16 is in the retracted, vertically oriented position. Therefore, footrest 16 will pivot away from any object or body part entrapped between footrest 16 and the remainder of the furniture item when moving into the fully upright position. This pivoting motion occurs without interference from the remainder of furniture item 10 (FIG. 1).

Referring to FIG. 9C, the engagement of the stud 172 and the groove 176 allows downward movement of the footrest 16 in the direction of arrow 180 when footrest 16 is in the extended, horizontally oriented position. The extension 30 and footrest 16 rotate about pivot point 32, the stud 172 traveling in the groove 176.

Operating furniture item 10 to move between three different positions will be understood generally with reference to FIGS. 1–6. In the fully upright position shown in FIGS. 1 and 4, footrest 16 is maintained in a generally vertical orientation, but may pivot as shown in FIG. 9B. To move furniture item 10 to the intermediate reclined or T.V. position shown in FIGS. 2 and 5, the seat occupant activated the drive assembly 112 to rotate the drive tube 110.

As further shown in FIG. 5, the above-described movement of actuating structure 113 extends footrest support bar 26 and footrest 16 as best shown in FIG. 2. Footrest 16 initially moves downward and then moves in an upward arc to the extended position. During extension, footrest 16 is also pivoted about pivot connection 32 to the generally horizontal orientation shown in FIG. 2. This occurs by the over-center spring action discussed in connection with FIGS. 9A and 9C. During the extension of footrest support bar 26, the S-shape of bar 26 in concert with the shape of slot 38 imparts a natural and comfortable movement to footrest 16 between the retracted and extended positions. To further move mechanism 20 into the fully reclined position shown in FIGS. 3 and 6, the seat occupant applies reward pressure against backrest 12 (FIG. 1) thereby pivoting backrest link 58 as shown in FIG. 3. Through the backrest linkage 24 and the connection with base link 88 provided through link 72, this forces seat link plate 22 and the attached link 94 and rollers 106, 108 to move in a forward direction. Rollers 106, 108 travel up tracks 84, 86. The full reclining movement is stopped when rollers 106, 108 reach the ends of respective tracks 84, 86. To move back into the intermediate reclined or T.V. position, the seat occupant releases their weight from backrest 12 and, to move into the fully upright position, the drive assembly 112 and the connected drive tube are rotated in a direction opposite to the actuating direction. This reverses the arc-shaped extension motion of footrest 16. Also, toward the end of its retraction, footrest 16 will move briefly upward to tuck underneath seat 14 in a generally vertical orientation.

While the present invention has been illustrated by a description of a preferred embodiment and while this embodiment have been described in considerable detail in order to describe the best mode of practicing the invention, it is not the intention of applicant to restrict or in any way limit the scope of the appended claims to such detail. As some examples, the various linkage configurations, connections, etc., may differ significantly from mechanism to mechanism. A connection between two elements need not be a direct connection but may be a connection made through other structure. Also, with respect to the S-shaped section of the footrest support bar or the contemplated S-shaped track, although the preferred support bar is shown with an overall gradual, continuously curving S-shape, this term is meant to include other generally S-shaped configurations, including those having straight end portions, for example, or other curving portions. In combination with the curved track, the disclosed configuration is deemed to provide a desirable footrest movement. The configuration also functions well if the track is generally straightened except for a downwardly curved front end portion. Other combinations of curved track and support bar sections, for example, in combination with a linkage assembly may work as well while retaining the general inventive apparatus and method. Additional advantages and modifications within the spirit and scope of the invention will readily appear to those skilled in the art.

The invention itself should only be defined by the appended claims, wherein it is claimed:

1. A reclining mechanism for a furniture item to allow movement of the furniture item between upright and reclined positions, the reclining mechanism comprising:

support structure adapted for attachment to the furniture item, linkage coupled with said support structure and operative to move the furniture item between the upright and reclined positions, a footrest support bar connected for longitudinal movement with respect to the support structure between extended and retracted positions, the footrest support bar having an S-shaped section located between first and second ends, said first end adapted for connection to a footrest member for supporting legs of a seat occupant, and actuating structure connected with said footrest support bar and operable to move said footrest support bar along said S-shaped section between said extended and retracted positions, said actuating structure being driven by a motorized drive assembly.

2. The reclining mechanism of claim 1, wherein the footrest support bar includes at least one roller attached for rotation thereto and the support structure further includes a track, said roller being mounted for movement along said track between the extended and retracted positions.

3. The reclining mechanism of claim 2, wherein said track includes first and second ends and at least one curved section between the first and second ends.

4. The reclining mechanism of claim 3, wherein the curved section of said track curves upward and then downward from a rear portion to a front portion thereof.

5. The reclining mechanism of claim 2, wherein the support structure includes a seat supporting member mounted adjacent the footrest support bar in a manner allowing said actuating structure to travel along said track as the footrest support bar moves between the extended and retracted positions.

6. The reclining mechanism of claim 2, wherein the roller is attached proximate the second end of said footrest support bar.

7. The reclining mechanism of claim 6, wherein the track includes first and second stops and said roller engages said stops at the respective upright and reclined positions.

8. The reclining mechanism of claim 2, wherein the roller is further connected for movement with said actuating structure along said track.

9. A three way reclining mechanism for moving an item of furniture between upright, intermediate reclined and fully reclined positions, the mechanism comprising:

a base member, seat supporting linkage, backrest linkage connected to a rear end of said seat supporting linkage and including a pivoting backrest link for attachment to a backrest and operable to pivot with respect to said seat supporting linkage, an S-shaped footrest support bar connected to a forward end of said seat supporting linkage to allow extension and retraction of said footrest support bar, actuating structure connected with said S-shaped footrest support bar for moving the S-shaped footrest support bar between extended and retracted positions as said mechanism moves between the upright position and the intermediate reclined position; and a motorized drive assembly coupled to said actuating structure to drive said S-shaped footrest support bar between the extended and retracted positions.

10. The reclining mechanism of claim 9, wherein the footrest support bar includes at least one roller attached for rotation thereto and the seat supporting linkage includes a track, said roller being mounted for movement along said track between the extended and retracted positions.

11. The reclining mechanism of claim 10, wherein said track includes first and second ends and at least one curved section between the first and second ends.

12. The reclining mechanism of claim 11, wherein the curved section of said track curves upward and then downward from a rear portion to a front portion thereof.

13. The reclining mechanism of claim 11, wherein the seat supporting linkage is mounted adjacent the footrest support bar in a manner allowing said actuating structure to travel along said track as the footrest support bar moves between the extended and retracted positions.

14. The reclining mechanism of claim 11, wherein the roller is attached proximate the second end of the footrest support bar.

15. The reclining mechanism of claim 11 further comprising at least a second roller connected with the seat supporting linkage adjacent said footrest support bar, said second roller engaging the footrest support bar during movement between the extended and retracted positions.

16. The reclining mechanism of claim 11 further comprising upper and lower rollers connected with the seat supporting linkage adjacent the footrest support bar, said upper and lower support rollers supporting and guiding the footrest support bar during movement between the extended and retracted positions.

17. The reclining mechanism of claim 16 wherein one of said upper and lower support rollers has a diameter larger than the other support roller.

18. A reclining mechanism for a furniture item to allow movement of the furniture item between upright and reclined positions, the reclining mechanism comprising:

support structure adapted for attachment to the furniture item, a track connected with the support structure, a footrest support bar connected with said track for longitudinal movement with respect to the support structure between extended and retracted positions, at least one of said track and said footrest support bar having an S-shaped section, actuating structure connected with said footrest support bar and operable to move said footrest support bar along said S-shaped section between said extended and retracted positions; and a motorized drive assembly operatively coupled to said actuating structure.

19. A reclining furniture item movable between upright, intermediate reclined and fully reclined positions, the furniture item comprising:

a base member;

a backrest, a seat and a footrest connected for movement with respect to said base member by a pair of reclining mechanisms, each reclining mechanism including:

i) seat supporting linkage including a seat link connected to said seat, ii) backrest linkage connected to a rear end of said seat supporting linkage and including a pivoting backrest link connected to said backrest and operable to allow pivoting of said backrest with respect to said seat, iii) a track connected with said seat link, iv) a footrest support bar connected to a forward end of said seat supporting linkage and connected with said footrest to allow extension and retraction of said footrest when moving between the upright position and the intermediate reclined position, at least one of said track and said footrest support bar having an S-shaped section, v) actuating structure connected with said footrest support bar for moving the footrest support bar along said S-shaped section between extended and retracted positions as said furniture item moves between the upright position and the intermediate reclined position, and vi) a drive assembly located between said pair of reclining mechanisms, said drive assembly being adapted to operate said actuating structure.

20. The reclining mechanism of claim 19 wherein the drive assembly includes a threaded drive shaft.

21. A reclining mechanism for a furniture item to allow movement of the furniture item by an occupant between upright and reclined positions, the reclining mechanism comprising:

support structure adapted for attachment to the furniture item, footrest actuating structure connected with said support structure and operable by the furniture occupant, and a footrest member having a rear edge and a front edge, the front rest member connected to the footrest actuating structure for movement between a retracted position with the rear edge above the front edge and an extended, leg supporting position with the rear edge behind the front edge, wherein said footrest member is pivotally connected to said footrest actuating structure in a spring-biased manner allowing pivoting, spring-biased motion in two directions whereby the front edge is pivotal downward in the leg supporting position and the rear edge is pivotal outward in the retracted position; and a motorized drive mechanism operable to actuate said footrest actuating structure.

22. A reclining mechanism for a furniture item having a seat and a backrest and allowing movement of the furniture item between upright and reclined positions, the reclining mechanism comprising:

support structure adapted for attachment to the furniture item, linkage coupled with said support structure and operative to move the seat and backrest between the upright and reclined positions, a footrest support bar connected for movement with respect to the support structure between extended and retracted positions, the footrest support bar having first and second ends, said first end adapted for connection to a footrest member for supporting legs of a seat occupant and said second end being positioned generally adjacent and below a front edge of the seat when connected to said furniture item and disposed in the extended position, actuating structure connected with said footrest support bar and operable to move said footrest support bar between the extended and retracted positions, wherein movement from the retracted position to the extended position includes an initial downward and outward movement followed by an upward and outward movement through an arc, and a motorized drive mechanism operable to actuate said actuating structure.

23. The reclining mechanism of claim 22 further comprising said footrest member pivotally connected to the first end of said footrest support bar and pivotal from a generally vertical orientation in the retracted position to a generally horizontal position in the extended position.

24. The reclining mechanism of claim 23, wherein said footrest member includes an upper edge and a lower edge when in the retracted position and said footrest member is biased such that the lower edge pivots outwardly as the footrest support bar is moved from the retracted position toward the extended position.

* * * * *